US009334032B2

(12) United States Patent
Yuchasz

(10) Patent No.: US 9,334,032 B2
(45) Date of Patent: May 10, 2016

(54) PADDLEBOARD AND PADDLE CARRYING SYSTEM

(71) Applicant: David Yuchasz, Kenmore, WA (US)

(72) Inventor: David Yuchasz, Kenmore, WA (US)

( * ) Notice: Subject to any disclaimer, the term of this patent is extended or adjusted under 35 U.S.C. 154(b) by 0 days.

(21) Appl. No.: 14/521,728

(22) Filed: Oct. 23, 2014

(65) Prior Publication Data

US 2015/0175247 A1 Jun. 25, 2015

Related U.S. Application Data

(60) Provisional application No. 61/920,627, filed on Dec. 24, 2013.

(51) Int. Cl.
*B63H 16/04* (2006.01)
*B63B 35/79* (2006.01)

(52) U.S. Cl.
CPC ..... *B63H 16/04* (2013.01); *B63B 35/7906* (2013.01)

(58) Field of Classification Search
CPC B63B 35/79; B63B 35/7946; B63B 35/7906; B63H 16/04
USPC ..... 441/74, 65, 79
See application file for complete search history.

(56) References Cited

U.S. PATENT DOCUMENTS 4,194,458 A * 3/1980 Messing ..... B63B 35/7943 114/363
5,127,862 A * 7/1992 Pia ..... B63B 35/7906 114/39.14

* cited by examiner

*Primary Examiner* — Lars A Olson
(74) *Attorney, Agent, or Firm* — Dean A. Craine

(57) ABSTRACT

A paddleboard and paddle carrying system that includes a modified paddle board with a longitudinally aligned paddle cavity on the paddleboard's top surface. The paddle cavity is configured to hold an elongated paddle in a flat configuration and flush or slightly below the top surface of the paddleboard. In one embodiment, the paddle is designed to snap fit into the paddle cavity and resist detachment. In one embodiment, the paddle cavity is formed directly into the paddleboard. In another embodiment, the paddle cavity is separately formed into an insert member that fits into a complimentary-shaped insert cavity longitudinally aligned and formed on the paddleboard body. In both embodiments, at least one wide hand grip cutout is formed on the paddleboard or on the insert member near the paddleboard's center of gravity enabling the user to extend his or her hand around the exposed section of the handle inside the paddle cavity and grip the handle and carry the paddleboard and paddle as a single unit under the user's arm.

10 Claims, 4 Drawing Sheets

PADDLEBOARD AND PADDLE CARRYING SYSTEM

This utility patent application is based on and claims the filing date benefit of U.S. provisional patent application (Application Ser. No. 61/920,627) filed on Dec. 24, 2013.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to paddleboards, and more particular to paddleboard accessories that attach a paddle to the paddleboard enabling the paddleboard and paddle to be manually carried as a single unit.

2. Description of the Related Art

Paddleboards are made up of composite materials consisting of a core, usually of foam or wood, wrapped in fiberglass or carbon cloth and mixed with resins which hardens the surface and strengthens the board. Paddleboards are sufficiently rigid to support a user standing up and using an elongated paddle to propel the paddleboard in the water or support a user lying horizontally in a prone position on the paddleboard and using his or her both arms to propel the paddleboard in the water. During use, the user may change riding positions. A common problem is where to temporarily store the paddle in a convenient location that does not interfere with use of the paddleboard.

What is needed is a paddleboard with a paddle carrying system that enables the paddle to be temporarily stored inside the paddleboard allowing the user to comfortably lay horizontally over the top surface of the paddleboard or stand or kneel upright on the paddleboard. When laying horizontally on the paddleboard, the user may use his or her arms to propel the paddleboard in the water. When standing or kneeling, the user may use the paddle to propel the paddleboard in the water.

Paddleboards are often 8 to 12 feet in length and awkward to carry on land. Depending of the size of the paddleboard and the size of the user, paddleboards are usually vertically aligned on one edge and transported horizontally under one arm with one hand extended under the lower edge of the paddleboard. If the user's arms are too short and the user is unable to grip the lower edge of the paddleboard with one hand, the user must extend his or her arm over the paddleboard and tightly squeeze the paddleboard against the sides of the body. Both carrying methods are difficult when carrying a paddle.

What is also needed is a paddleboard and a paddle carrying system that enables the paddleboard and the paddle to be easily transported on one edge and as a single unit.

SUMMARY OF THE INVENTION

This invention comprises a modified paddleboard with an elongated paddle cavity in the shape of an elongated paddle built into the paddleboard's top surface. In one embodiment, the paddle cavity is formed directly in the paddleboard's top surface and the core material and covered with fiberglass or carbon cloth before finishing off the paddleboard with resin. In a second embodiment, the paddle cavity is formed into a rectangular-shaped insert member attached and inserted into a complimentary-shaped insert cavity formed in the paddleboard's body. In both embodiments, the paddle cavities are recessed and longitudinally aligned on the paddleboard. They are also sufficiently deep so when a paddle is placed therein, the blade and handle are slightly below or flush with the top surface of the paddleboard enabling the user to lie horizontally and comfortably over the board's top surface. In one embodiment, the paddle cavity includes a narrow handle section with an optional hand grip cutout formed on the paddleboard and adjacent to the paddle cavity and configured to allow a user to grip the exposed portion of the handle that extends through the grip cutout. The hand grip cutout is near or at the paddleboard's center of gravity so the user's hand acts as a fulcrum when transporting the paddleboard on edge under the arm and gripping the exposed portion of the handle.

The paddle is tightly held inside the paddle cavity thereby enabling the paddleboard and the paddle to be easily transported as a single unit. Straps located inside the paddle cavity may extend over the handle when disposed inside the paddle cavity or resilient lip protrusions may be formed on the inside walls of the paddle cavity enable the paddle to 'snap fit into the paddle cavity to hold the paddle therein. The lip protrusions may extend the entire length of the handle thereby reducing the wide of the gap formed on the paddleboard's top surface

DESCRIPTION OF THE PREFERRED EMBODIMENT(S)

Figure 1:
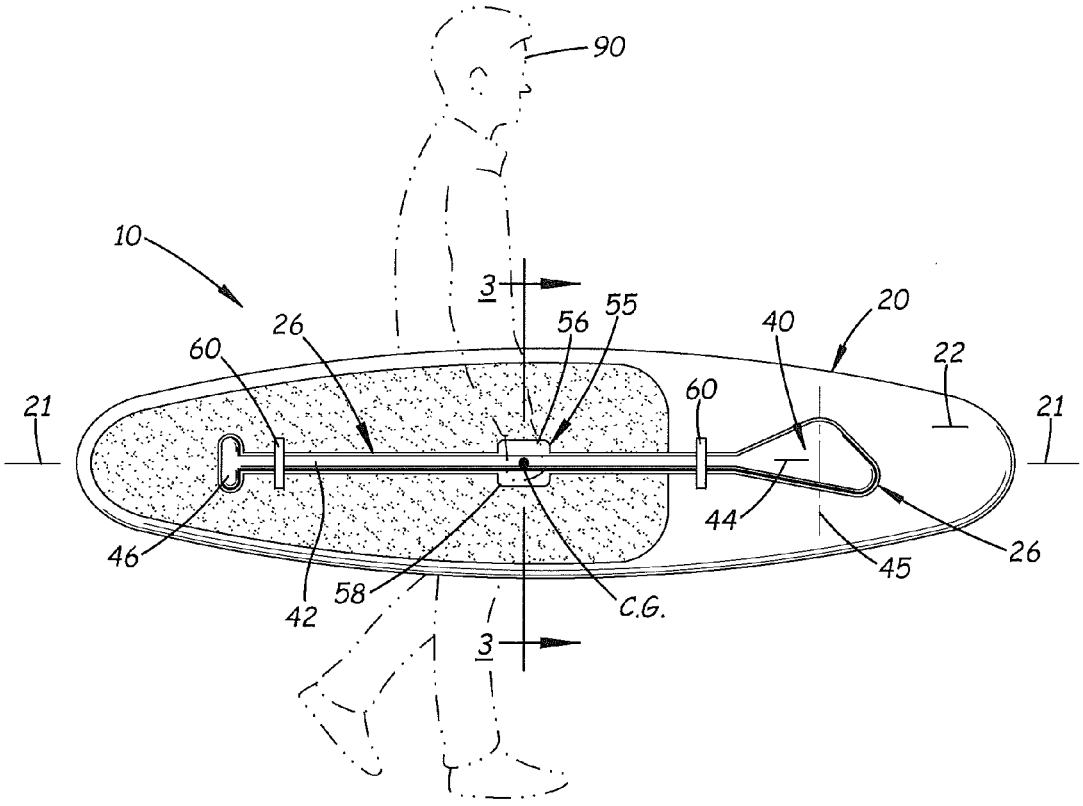
FIG. 1 is a top plan view of a paddleboard showing with a paddle cavity formed therein configured to receive an elongated paddle.

A paddleboard and paddle carrying system 10 that includes a modified paddleboard 20 with a paddle-shaped paddle cavity 26 formed on the paddleboard's top surface 22 and aligned over the paddleboard's longitudinal axis 21. The paddle cavity 26 is configured to receive and temporarily hold a paddle 40 with an elongated handle 42, a wide blade 44 and an optional hand grip 46 on the end of the handle 42 opposite the wide blade 44. When assembled, the paddle 40 is longitudinally aligned inside the paddle cavity 26 and the top surfaces of the elongated handle 42, the blade 44 and handle grip 46 are positioned slightly below or even or flush with the paddleboard's top surface 22.

Figure 3:
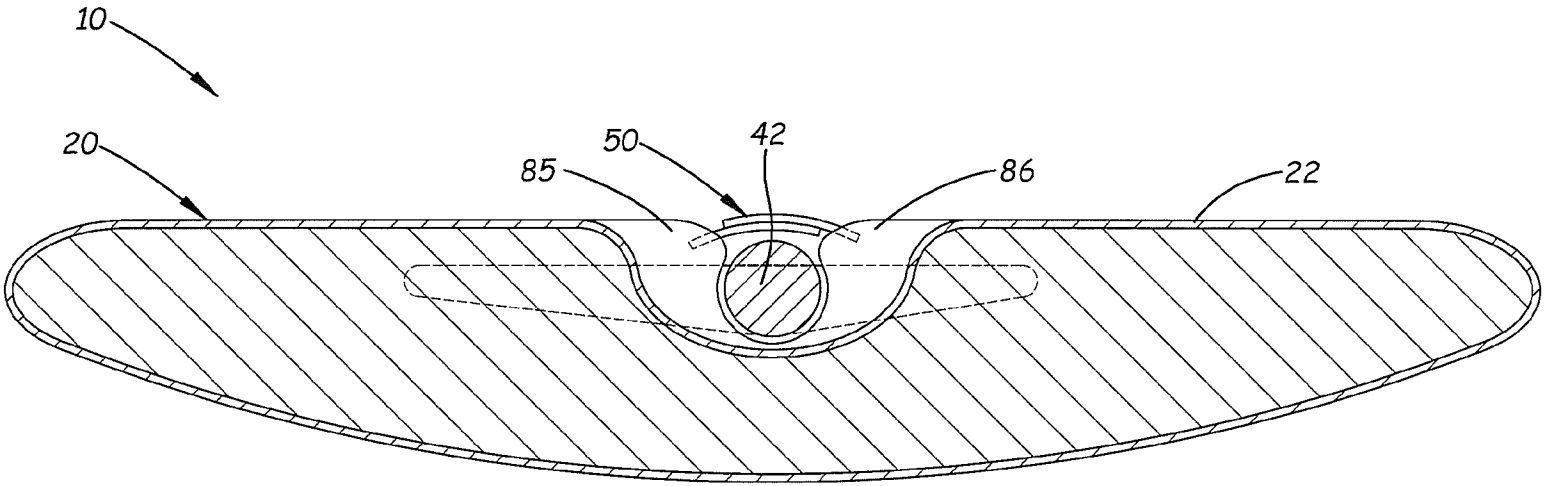
FIG. 3 is a sectional front elevation view taken along line 3-3 in FIG. 2 showing a paddle handle placed inside the paddle cavity of the paddleboard.

In the first embodiment shown herein, the paddle cavity 26 is sufficiently deep and configured to hold the entire paddle 40 with the wide axis 45 of the wide blade 44 laid flat and transversely aligned on the paddleboard 20 as shown in FIG. 1. The paddle cavity 26 includes one or two pairs of inward lip protrusions 85, 86 formed on the inside side walls that hold the paddle 40 inside the paddle cavity 26. The lip protrusions 85, 86 are located on opposite sides of the side walls and are made of resilient material that allows the paddle 20 to 'snap fit' into the paddle cavity 26, (see FIG. 3). The lip protrusion 85, 86 are located in the paddle cavity 26 where the handle 42 is placed thereby reducing the gap size of the paddle cavity 26. Optional straps 50, 52 made of hook or loop material or similar material may be used to securely hold the paddle 40 in the paddle cavity 26. The ends of the two straps 50, 52 are attached to the side walls of the paddle cavity 26 and the strap's free ends extend around the handle 42 and are interconnected to hold the paddle 40 inside the paddle cavity 26

Figure 2:
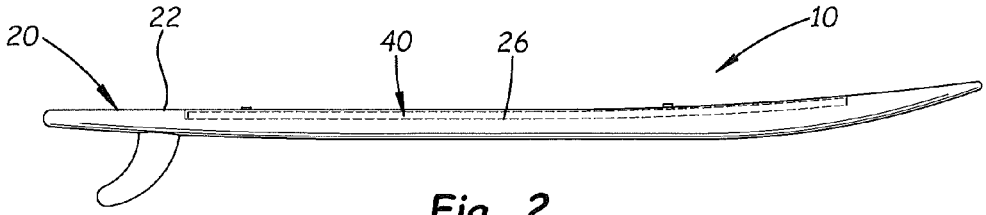
FIG. 2 is a top plan view of the paddleboard showing the paddle disposed into the paddle cavity.

In one embodiment, the wide hand void area 55 is formed by two wide cutouts 56, 58 formed on the opposite sides of the paddle cavity 26 near the paddleboard's mid-line traverse axis. The two cutouts 56, 58 are configured to allow a user 90 to grip the handle 42 with one hand and simultaneously transport the paddleboard 20 and paddle 40 horizontally and on edge by gripping the handle 42 as shown in FIG. 2.

Figure 4:
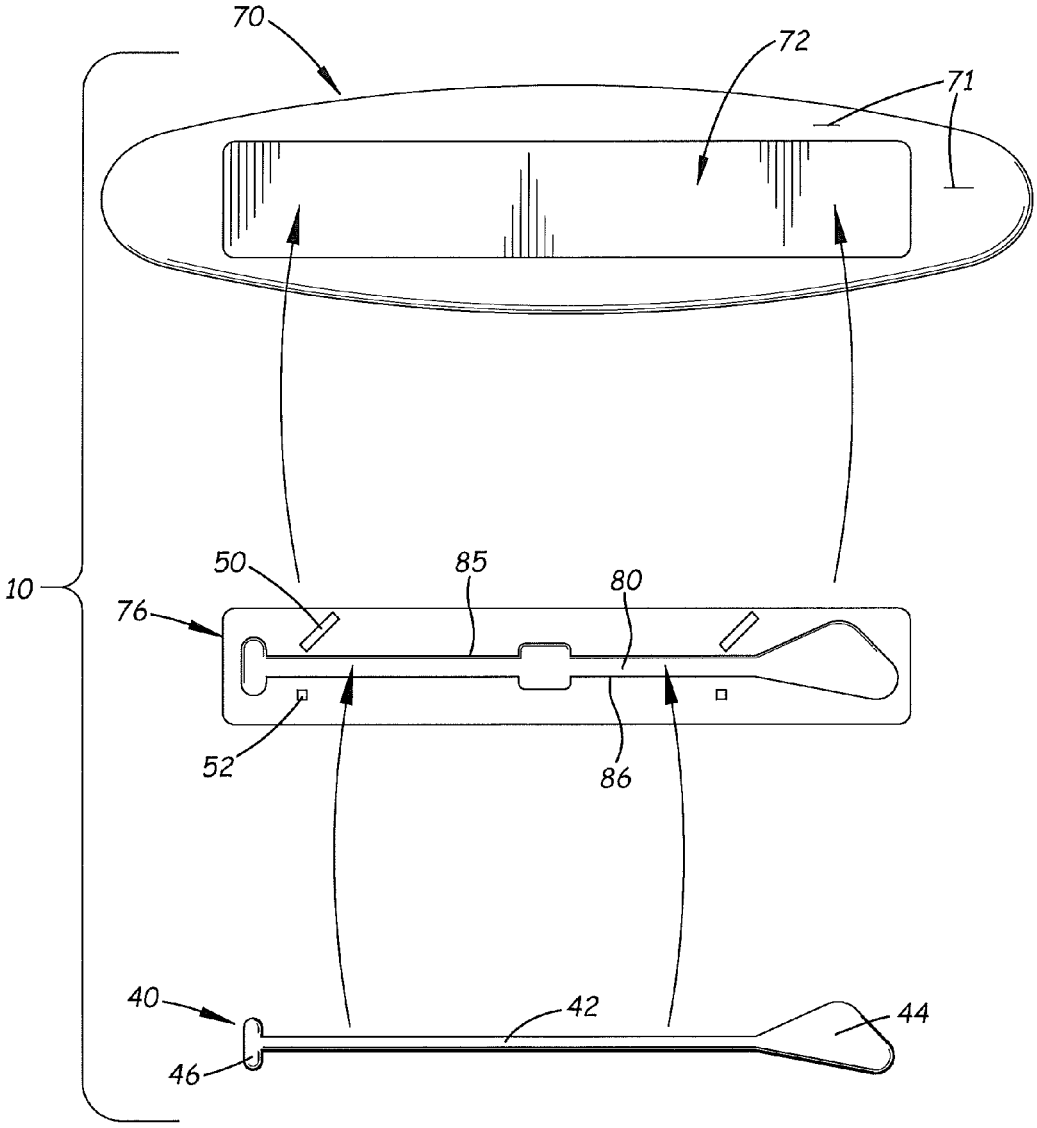
FIG. 4 is an exploded top plan view of second embodiment of the paddleboard with an insert cavity that receives a rectangular shaped insert member with a paddle cavity formed longitudinally in the insert member with a paddle being inserted into the paddle cavity.
Figure 5:
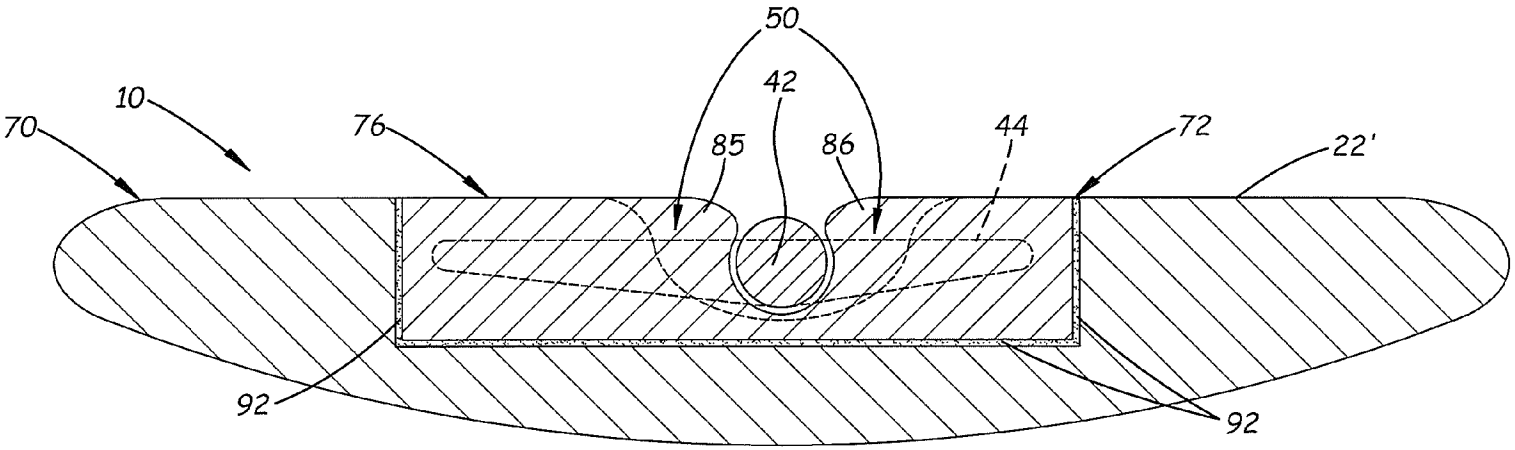
FIG. 5 is a sectional front elevation view taken of the second embodiment of the paddleboard with an insert member and showing a paddle placed inside the paddle cavity.

In a second embodiment shown in FIGS. 4 and 5, the system 10 includes an alternative paddleboard, denoted by reference number 70, with a longitudinally aligned, rectangular shaped insert cavity 72 configured to received a rectangular-shaped insert member 76 with a paddle-shaped paddle cavity 80 formed therein. During assembly, the insert member 76 is longitudinally aligned and inserted into the insert cavity 72. During use, a paddle 40 is disposed inside the paddle cavity 80. The insert cavity 72 and the insert member 76 and the paddle cavity 80 are sufficiently deep so that the paddle 40 is flush or slightly below the top surface 71 of the paddleboard 70 as shown in FIG. 5.

A suitable adhesive 92 is applied to the bottom and side walls of the insert cavity 72 to attach the insert member 76 inside the insert cavity 72

Like the first embodiment, straps 50, 52 extend over the elongated handle 42 when disposed inside the paddle cavity 80 and interconnected to hold the paddle 40 inside the paddle cavity 80. Also, one or two pairs of inward lip protrusions 85, 86 may be formed or attached to the inside walls of the paddle cavity 80 that hold the paddle 40 inside the paddle cavity 80.

Paddleboards 20, 70 are nine and twelve feet in length and paddles 40 are usually a fixed length between 60 to 90 inches. Alternatively, the paddles 40 may be telescopically adjustable between 60 and 90 inches. The shape and length of the paddle cavities 26, 80 depend of the shape and length of the paddleboard 20, 70 and on the shape and length of the paddle 40.

In the embodiment shown in FIGS. 4 and 5, the insert member 76 is designed to accommodate the paddle 40 and fit within the top surface of paddleboard and not negatively impact the strength and durability of the paddleboard 20. In the embodiment shown, the insert member 76 is rectangular with two parallel side walls, two parallel end walls, and parallel top and bottom surfaces. The insert member 76 measures two to four inches in length longer than the paddle 40 and one to two inches greater in width than the paddle's wide blade 44. The insert member 76 is centrally aligned on the paddleboard 20 and has a width approximately two inches less than the paddleboard's widest transverse axis. The insert member 76 is also approximately 2 inches deep and made of made of fiberglass or thermoplastic composite material. The insert member 76 enables a paddleboard manufacturer to easily manufacture paddleboards that accommodate different paddle shapes and sizes. It should be understood that the insert member may be made in different shapes and sizes.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A paddleboard and paddle carrying system, comprising:

a. a paddleboard with a top surface, a longitudinal axis and a center of gravity;

b. an insert cavity longitudinally aligned on the paddleboard, c an insert member inserted into the insert cavity;

d. a paddle with a blade and a handle; and, e. a paddle cavity formed on the insert member and aligned with the longitudinal axis of the paddleboard, the paddle cavity configured to receive and temporarily hold the paddle longitudinally on the paddleboard and flush or slightly below the top surface of the paddleboard.

2. The system, as recited in claim 1, wherein the paddle cavity includes a hand grip cutout configured to allow a user to grip the handle of the paddle when the paddle is disposed inside the paddle cavity, the hand grip cutout being located near the paddleboard's center of gravity.

3. The system, as recited in claim 1, further including straps that extend over and hold the paddle inside the paddle cavity.

4. The system, as recited in claim 2, further including straps that extend over and hold the paddle inside the paddle cavity.

5. A paddleboard and paddle carrying system, comprising:

a. a paddleboard with a top surface, a longitudinal axis and a center of gravity;

b. a paddle with a blade and a handle; and, c. a paddle cavity located on the top surface of the paddleboard and aligned with the longitudinal axis, the paddle cavity configured to receive and temporarily hold the paddle longitudinally on the paddleboard and flush or slightly below the top surface of the paddleboard, said paddle cavity further including at least two inward protruding lips formed on the paddle cavity configured to allow the paddle to be pressed and snap fit into the paddle cavity held longitudinally inside the paddle cavity.

6. The system, as recited in claim 1, further including at least two inward protruding lips formed on opposite sides of the paddle cavity that hold the paddle longitudinally inside the paddle cavity.

7. The system, as recited in claim 2, further including at least two inward protruding lips formed on the paddle cavity that hold the paddle inside the paddle cavity.

8. The system, as recited in claim 2, further including an adhesive used to attach the insert member to said insert cavity.

9. The system, as recited in claim 8, further including straps that hold the paddle inside the paddle cavity.

10. The system, as recited in claim 8, further including inward protruding lips formed on the paddle cavity configured to hold the paddle longitudinally inside the paddle cavity.

* * * * *